US005992325A

United States Patent [19]

Schumann et al.

[11] Patent Number: 5,992,325

[45] Date of Patent: Nov. 30, 1999

[54] METHOD AND DEVICE FOR AUTOMATICALLY DETECTING AT LEAST ONE PRINTING PLATE EDGE

[75] Inventors: Frank Schumann, Heidelberg; Stephan Rudzewitz, Walldorf, both of Germany

[73] Assignee: Heidelberger Druckmaschinen Aktiengesellschaft, Heidelberg, Germany

[21] Appl. No.: 09/243,834

[22] Filed: Feb. 1, 1999

[30] Foreign Application Priority Data

Jan. 30, 1998 [DE] Germany ..... 198 03 724

[51] Int. Cl.[6] ..... B41F 1/28

[52] U.S. Cl. ..... 101/477; 101/415.1

[58] Field of Search ..... 400/477, 483, 400/415.1

[56] References Cited

U.S. PATENT DOCUMENTS

| | | | |
|---|---|---|---|
| 5,394,614 | 3/1995 | Lindner et al. | 33/621 |
| 5,479,859 | 1/1996 | Lindner et al. | 101/485 |
| 5,634,406 | 6/1997 | Lindner et al. | 101/486 |
| 5,666,881 | 9/1997 | Zanoli | 101/477 |
| 5,868,072 | 2/1999 | Nishi | 101/415.1 |

FOREIGN PATENT DOCUMENTS

| | | |
|---|---|---|
| 0 551 976 B1 | 7/1993 | European Pat. Off. . |
| 0 653 301 A1 | 5/1995 | European Pat. Off. . |
| 35 27 103 A1 | 10/1986 | Germany . |
| 42 26 780 C2 | 12/1994 | Germany . |
| 196 11 530 C1 | 10/1997 | Germany . |
| 196 36 703 A1 | 3/1998 | Germany . |
| 2 275 655 | 9/1994 | United Kingdom . |
| 2311254 | 9/1997 | United Kingdom . |

*Primary Examiner*—Edgar Burr
*Assistant Examiner*—Dave A Ghatt
*Attorney, Agent, or Firm*—Herbert L. Lerner; Laurence A. Greenberg

[57] ABSTRACT

A method for automatically detecting at least one printing plate edge in at least one clamping device of a plate cylinder of a printing press includes detecting at least one of a position of a printing plate edge and a respective presence and absence of a printing plate edge in the at least one clamping device by at least one sensor, the printing plate edge being detected being the printing plate trailing edge, and the clamping device by which it is detected being the trailing edge clamping device, and a device for performing the detecting method, including at least one sensor disposed in a trailing edge clamping device of the plate cylinder for detecting at least one of a position of the printing plate trailing edge and a respective presence and absence of the printing plate trailing edge in the trailing edge clamping device, and at least one transmitter for transmitting the signals from the plate cylinder to stationary parts of the printing press.

23 Claims, 1 Drawing Sheet

METHOD AND DEVICE FOR AUTOMATICALLY DETECTING AT LEAST ONE PRINTING PLATE EDGE

BACKGROUND OF THE INVENTION

1. Field of the Invention

The invention relates to a method for automatically detecting at least one printing plate edge in at least one clamping device of a plate cylinder of a printing press, the presence or absence and/or the position of a printing plate edge in the at least one clamping device being detected by at least one sensor.

The invention relates, furthermore, to a device for performing the foregoing method, with at least one sensor disposed in a clamping device of a plate cylinder and constructed for detecting the presence or absence and/or the position, respectively, of a printing plate edge in the at least one clamping device, and with at least one transmitter for transmitting the signals from the plate cylinder to stationary parts of the printing press.

When printing plates were still clamped onto plate cylinders of printing presses by hand, it was also possible to detect visually whether a printing plate edge, i.e., a trailing or a leading edge, was located in the clamping device provided for the purpose, or whether the edge was completely removed from the latter. The person involved could sometimes even detect the position of a printing plate edge in the clamping device purely by feeling or instinct. It was consequently possible to prevent damage to the printing press or to the printing plates that may occur due to errors in clamping or unclamping. With the advent of automatic clamping devices, this control or check became more difficult and, due to semiautomatic or fully automatic printing plate feeding and printing plate removal devices, it is often barely possible any more, because these devices are located in front or upline of the clamping devices.

The published European Patent Document EP 0 551 976 B1 presents a proposal of the type mentioned in the introduction hereto, but it is restricted to arranging sensors only at the leading edge clamping device, in order to detect the presence or absence and the position of the leading edge of the printing plate. This check or control is insufficient, however, because the clamping of the trailing edge must also be checked when the printing plate is being clamped. Even when the printing plate is unclamped, it is necessary to detect the clamping of the printing plate trailing edge. Only when the printing plate trailing edge has left the clamping device, is it possible for the plate cylinder to continue to rotate, and thereby unwind the printing plate and then unclamp the leading edge, without any risk of damage to the printing plate and/or the printing press. If malfunctions should occur and remain unnoticed during the aforedescribed operations, damage to the printing plate or to the printing press may occur during the further progress of the clamping or unclamping operations or at the start of printing. It is possible, for example, that the trailing edge may become released at a wrong instant of time and, when the rotating plate cylinder strikes against the blanket cylinder, inking rollers or other parts and damages them and, naturally, also the printing plate is damaged or destroyed.

SUMMARY OF THE INVENTION

It is accordingly an object of the invention to provide a method and a device for automatically detecting at least one printing plate edge, which are of the type mentioned in the introduction hereto, wherein damage to the printing press and/or the printing plate is avoided as a result of prompt automatic detection of the clamping operations.

With the foregoing and other objects in view, there is provided, in accordance with one aspect of the invention, a method for automatically detecting at least one printing plate edge in at least one clamping device of a plate cylinder of a printing press, which comprises detecting at least one of a position of a printing plate edge and a respective presence and absence of a printing plate edge in the at least one clamping device by at least one sensor, the printing plate edge being detected being the printing plate trailing edge, and the clamping device by which it is detected being the trailing edge clamping device.

In accordance with another mode, the method of the invention includes furthering an operation for unclamping a printing plate only when the at least one sensor has transmitted to a control of the printing press a signal that the printing plate trailing edge has left the trailing edge clamping device.

In accordance with a further mode, the method of the invention includes detecting by at least one sensor the printing plate leading edge in a leading edge clamping device.

In accordance with an added mode, the method of the invention includes clearing the plate cylinder for a new printing plate to be tautened thereon, only when the at least one sensor has transmitted to the printing press control a signal that the printing plate leading edge has left the leading edge clamping device.

In accordance with an additional mode, the method of the invention includes continuing the tautening of a new printing plate on the plate cylinder only when the at least one sensor has transmitted to the printing press control a signal that the printing plate leading edge is suitably positioned in the leading edge clamping device.

In accordance with yet another mode, the method of the invention includes clearing the printing press for printing only when the at least one sensor has transmitted to the printing press control a signal that the printing plate trailing edge is suitably positioned in the trailing edge clamping device.

In accordance with yet a further mode, the method of the invention includes transmitting signals from the at least one sensor in a contact-free manner from the plate cylinder to stationary parts of the printing press.

In accordance with another aspect of the invention, there is provided a device for performing a method of automatically detecting at least one printing plate edge in at least one clamping device of a plate cylinder of a printing press, comprising at least one sensor disposed in a trailing edge clamping device of the plate cylinder for detecting at least one of a position of the printing plate trailing edge and a respective presence and absence of the printing plate trailing edge in the trailing edge clamping device, and at least one transmitter for transmitting the signals from the plate cylinder to stationary parts of the printing press.

In accordance with a further feature, the detecting device of the invention includes at least one sensor disposed in a leading edge clamping device of the plate cylinder.

In accordance with an added feature of the detecting device of the invention, the transmitter is so constructed as to transmit the signals from the plate cylinder in a contact-free manner to stationary parts of the printing press.

In accordance with an additional feature of the detecting device of the invention, the transmitter includes at least two coils which are located opposite one another at least once during each revolution of the plate cylinder.

In accordance with yet another feature of the detecting device of the invention, the printing press has a press control constructed so that it continues an operation of unclamping a printing plate only when the press control receives a signal from the at least one sensor that the printing plate trailing edge has left the trailing edge clamping device.

In accordance with yet a further feature of the detecting device of the invention, the press control is constructed so as to clear the plate cylinder for a new printing plate to be clamped thereon only when the press control receives a signal from the at least one sensor that the printing plate leading edge has left the leading edge clamping device.

In accordance with yet an added feature of the detecting device of the invention, the press control is constructed so as to continue an operation of clamping a new printing plate only when the press control receives a signal from the at least one sensor that the printing plate leading edge is suitably positioned in the leading edge clamping device.

In accordance with yet an additional feature of the detecting device of the invention, the press control is constructed so as to clear the printing press for printing only when the at least one sensor receives a signal that the printing plate trailing edge is suitably positioned in the trailing edge clamping device.

In accordance with still another feature of the detecting device of the invention, the at least one sensor comprises an electric contact which is closed due to the presence of a printing plate.

In accordance with still a further feature of the detecting device of the invention, the at least one sensor comprises an electric microswitch.

In accordance with still an added feature of the detecting device of the invention, the at least one sensor is an inductively acting sensor.

In accordance with a first alternative feature of the detecting device of the invention, the at least one sensor is a capacitively acting sensor.

In accordance with a second alternative feature of the detecting device of the invention, the at least one sensor is an optically acting sensor.

In accordance with a third alternative feature of the detecting device of the invention, the at least one sensor is an ultrasonic sensor.

In accordance with still an additional feature of the detecting device of the invention, the at least one sensor for the trailing edge clamping device is constructed so as to detect a required depth of engagement of a bent printing plate trailing edge in the trailing edge clamping device.

In accordance with a concomitant feature of the detecting device of the invention, the at least one clamping device has disposed therein two sensors located in an outer region of the at least one clamping device.

Thus, according to the invention, the printing plate trailing edge in the trailing edge clamping device is detected by at least one sensor.

With specific regard to the detecting device according to the invention, the objects of the invention are achieved by providing the trailing edge clamping device with at least one sensor.

The method according to the invention and the detecting device according to the invention offer the advantage that the clamping/tautening operations and the correct positioning of the printing plates in the clamping devices can be fully monitored, and all the operations can immediately be stopped automatically if faults should occur. Damage due to malfunctions is thereby ruled out almost completely.

With regard to the method of the invention, in a particularly important development, a printing plate clamping/tautening operation is furthered only when the at least one sensor has transmitted to the press control the signal that the printing plate trailing edge has left the trailing edge clamping device. With regard to the detecting device of the invention, the press control is so constructed that the detautening operation is furthered only when it has received the signal. This prevents an unclamping of the trailing edge that is incomplete or that occurs at a wrong time, from causing the aforementioned damage.

For a complete check of the operations, it is expedient if the printing plate leading edge in the leading edge clamping device is also detected by at least one sensor.

It is proposed, furthermore, with regard to the method of the invention, that the plate cylinder be cleared for the clamping of a new printing plate thereon, only when the operation of unclamping the old printing plate has ended, that is to say when the at least one sensor has transmitted to the press control a signal that the printing plate leading edge has left the leading edge clamping device. With regard to the detecting device of the invention, the press control is constructed so that it clears the plate cylinder for a new printing plate to be clamped thereon, only when the press control has received the signal. Assurance is thereby provided that the old printing plate is also actually removed prior to the feeding of a new printing plate onto the plate cylinder.

In a further proposal with regard to the method of the invention, the operation of clamping/tautening a new printing plate is furtrhered only when the at least one sensor has transmitted to the press control a signal that the printing plate leading edge is positioned in-register in the leading edge clamping device. Regarding the detecting device of the invention, the press control is constructed so that the operation of clamping the new printing plate after the signal has been received is furthered or continued. Consequently, damage is avoided, or the situation is also avoided wherein a printing plate not correctly clamped at the leading edge is fully tautened and, after the fault has been recognized, possibly only after the start of printing, the printing plate has to be removed again and the entire operation repeated.

With regard to the method of the invention, the monitoring of the clamping operation is also completed in that the printing press is cleared for printing only when the at least one sensor has transmitted to the press control a signal that the printing plate trailing edge is positioned in-register in the trailing edge clamping device. With regard to the detecting device of the invention, the press control is constructed so that it clears the printing press for printing only when the press control receives the signal. Assurance is thereby provided that printing will start only when the printing plates are perfectly tautened.

The signals from the sensors which are located on the plate cylinder are expediently transmitted in a contact-free manner from the plate cylinder to the stationary parts of the printing press and consequently to the press control. With regard to a detecting device of this general type, there are many possibilities: One proposal is that the transmitter be formed of at least two coils located opposite one another at least once during each revolution of the plate cylinder. In addition to a thus inductive signal transmission, however, an optical signal transmission, a radio transmission or any other type of signal transmission is also possible.

There are also many possibilities with regard to the construction of the sensors of the trailing edge clamping device and/or the leading edge clamping device of the plate cylinder. There may be electric contacts which are closed as a result of the presence of a printing plate. If these contacts are attached to register pins which engage in recesses formed in the printing plate, precise in-register positioning can also be detected. This method is expedient, above all, on the leading edge clamping device. However, the possibilities are not, of course, restricted to this proposal. Sensors of this type, also for detecting in-register accuracy, may also be in the form of microswitches, and inductively acting or capacitively acting sensors. Furthermore, they may also be in the form of optically acting sensors or ultrasonic sensors.

Printed plate trailing edges are often bent-away edges which are pushed into radially extending clamping jaws. It is then expedient for the sensors to be constructed so that they detect the depth of engagement of the bent trailing edge in the trailing edge clamping device, in order to monitor the correct complete insertion of the printing plate trailing edge.

There may be any number of sensors for each clamping device, but, as a rule, two sensors for each clamping device should be sufficient to make it possible to detect the positioning of the printing plate edges. The arrangement should be such that the sensors, respectively, are located in the outer region of the clamping devices. Other arrangements may, of course, also be envisioned, such as the detection of perforations, possibly in the form of register marks, arranged in the edge region of the printing plates, or additional detection of the outsides of a printing plate in a corner region of the printing plate edge to be clamped or tautened. Many other constructional possibilities are conceivable within the confines of the invention.

Other features which are considered as characteristic for the invention are set forth in the appended claims.

Although the invention is illustrated and described herein as embodied in a method and a device for automatically detecting at least one printing plate edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
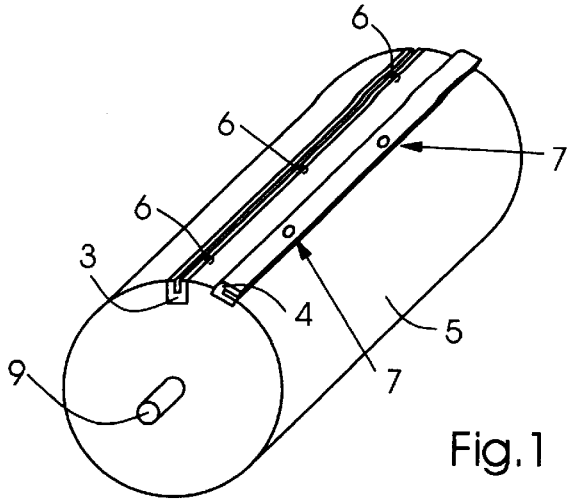
FIG. 1 is a perspective view of a plate cylinder with a trailing edge clamping device and a leading edge clamping device.

Referring now to the drawings and, first, particularly to FIG. 1 thereof, there is shown therein a plate cylinder 5 with a trailing edge clamping device 3 and a leading edge clamping device 4. The trailing edge clamping device 3 has radially extending clamping jaws for receiving therebetween a bent-away trailing edge 2 of a printing plate 8 (note FIG. 2, for example). Located on the clamping jaws of the trailing edge clamping device 3 are sensors 6 which detect the presence or absence of the printing plate trailing edge 2. The depth of engagement of the printing plate trailing edge 2 is also expediently detected, in order to check or determine that it has been pushed in completely.

Furthermore, the leading edge clamping device 4 has clamping jaws which extend in the tangential direction of the plate cylinder 5. Also arranged on the clamping jaws of the leading edge clamping device 4 are sensors 7 which detect the presence or absence of a leading edge 1 of the printing plate 8. The in-register reception of the printing plate leading edge 1 is also expediently detected by the sensors 7.

The signals from the sensors 6 and 7 are transmitted via a suitable transmitting member 9 from the plate cylinder 5 to stationary parts of the printing press and consequently to the press control that processes the signals further in the manner described hereinabove. As aforedescribed, the signal-transmitting member 9 operates preferably in a contact-free manner.

FIGS. 2 to 5 illustrate the operations or operating steps which are monitored by the sensors 6 and 7 and are controlled by the press control in the manner described hereinbefore, in order to avoid damage due to faulty operating steps.

Figure 2:
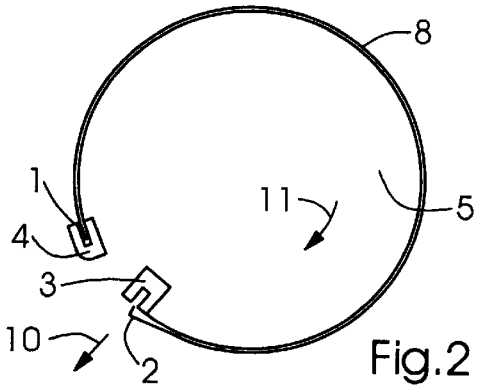
FIG. 2 is a diagrammatic end view of a plate cylinder carrying a printing plate of which the trailing edge is being unclamped.

FIG. 2 shows a plate cylinder 5 carrying a printing plate 8 which is to be removed. For that purpose, the trailing edge clamping device 3 has been opened, with the result that the resilient printing plate trailing edge 2 has sprung out in the direction of the arrow 10. Thereafter, the plate cylinder 5 rotates in the direction of the arrow 11, in order to unwind the printing plate 8 which is to be exchanged.

Figure 3:
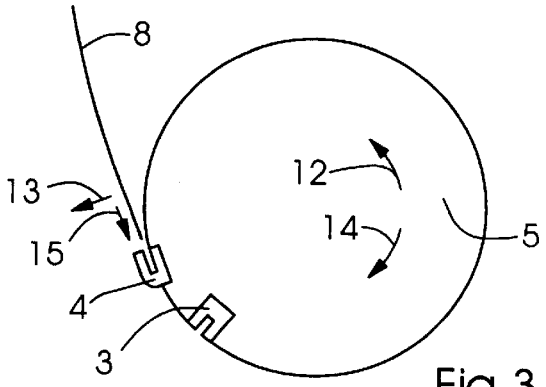
FIG. 3 is a view like that of FIG. 2, showing the leading edge of the printing plate being unclamped or clamped.

FIG. 3 shows, on the one hand, the unclamping of a printing plate leading edge 1. When the printing plate 8 is unwound from the plate cylinder 5, the leading edge clamping device 4 opens and the plate cylinder 5 rotates a slight distance in the direction of the arrow 12, with the result that the printing plate leading edge 1 moves out of the leading edge clamping device 4 in the direction of the arrow 13 due to the rotation of the plate cylinder 5.

FIG. 3 also shows, on the other hand, the clamping of a printing plate leading edge 1. For this purpose, as shown, the leading edge 1 of the printing plate 8 is fed from a location upline or in front of the leading edge clamping device 4. The leading edge clamping device 4 is opened and the plate cylinder 5 rotates in the direction of the arrow 14 until the leading edge clamping device 4 receives therein the printing plate leading edge 1 as a result of the relative movement represented by the arrow 15 between the printing plate 8 and the plate cylinder 5. When the printing plate leading edge 1 reaches the exact position thereof that is checked or determined by the sensors 7, the leading edge clamping device 4 closes.

Figure 4:
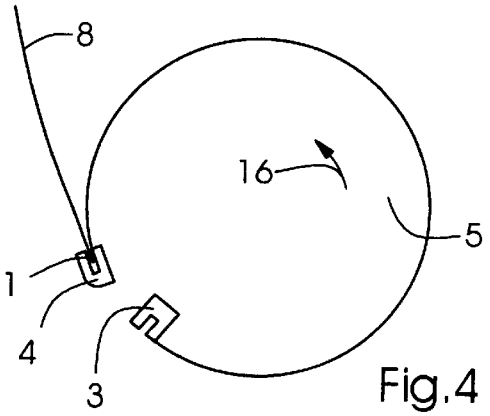
FIG. 4 is a view like that of FIG. 2 of a printing plate having a clamped leading edge and preparatory to being tautened.

FIG. 4 shows how the printing plate 8 is tensioned or tautened on the plate cylinder 5 after the printing plate leading edge 1 has been clamped in the manner illustrated in FIG. 3. With the leading edge clamping device 4 closed, the plate cylinder 5 rotates in the direction of the arrow 16 and winds the printing plate 8 on the circumference thereof until the position shown in FIG. 5 is reached.

Figure 5:
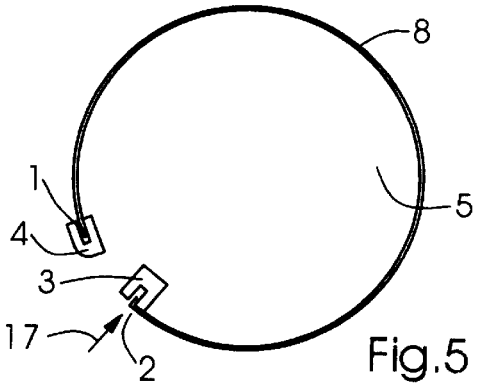
FIG. 5 is a view like that of FIG. 4, for example, showing a fully tautened printing plate clamped at both the leading and trailing edges thereof.

FIG. 5 shows the fully clamped and tensioned or tautened printing plate 8, the printing plate trailing edge 2, in a final operating step, having been inserted into the trailing edge clamping device 3, and the latter having been closed. Then, as a result of movement in the circumferential direction, the trailing edge clamping device 3 can also provide the printing plate 8 with the necessary tension for it to rest snugly on the plate cylinder 5.

With respect to the monitoring of the positionings of the printing plate edges 1 and 2 and the control of the operations by the press control, reference is made to the description provided hereinabove. Of course, these operations do not have to take place in the manner illustrated in FIGS. 2 to 5. What is shown therein is merely one embodiment of the device and one mode of the method according to the invention, for the purpose of providing an explanation thereof. Other embodiments of the device and modes of the method in accordance with the invention may also be used, such as, for example, the clamping of the printing plate trailing edge 2 can also take place tangentially, or the printing plates can have attached clamping bars.

We claim:

1. A method for automatically detecting a printing plate edge in a clamping device of a plate cylinder of a printing press, which comprises:

providing a trailing edge clamping device of a plate cylinder with a sensor; and detecting a presence and an absence of the printing plate trailing edge in the trailing edge clamping device with the sensor of the trailing edge clamping device.

2. The method according to claim 1, which includes furthering an operation for unclamping a printing plate only when the sensor of the trailing edge clamping device has transmitted to the printing press control a signal that the printing plate trailing edge has left the trailing edge clamping device.

3. The method according to claim 1, which includes:

providing a leading edge clamping device of a plate cylinder with a sensor; and detecting a presence and an absence of the printing plate leading edge in the leading edge clamping device with the sensor of the leading edge clamping device.

4. The method according to claim 3, which includes clearing the plate cylinder for a new printing plate to be tautened thereon, only when the sensor of the leading edge clamping device has transmitted to a printing press control a signal that the printing plate leading edge has left the leading edge clamping device.

5. The method according to claim 4, which includes furthering the tautening of a new printing plate on the plate cylinder only when the sensor of the leading edge clamping device has transmitted to the printing press control a signal that the printing plate leading edge is suitably positioned in the leading edge clamping device.

6. The method according to claim 5, which includes clearing the printing press for printing only when the sensor of the trailing edge clamping device has transmitted to the printing press control a signal that the printing plate trailing edge is positioned in-register in the trailing edge clamping device.

7. The method according to claim 1, which includes transmitting signals from the sensor of the trailing edge clamping device in a contact-free manner from the plate cylinder to stationary parts of the printing press.

8. A device for automatically detecting at least one printing plate edge in at least one clamping device of a plate cylinder of a printing press, comprising at least one sensor disposed in a trailing edge clamping device of the plate cylinder for detecting a presence and an absence of the printing plate trailing edge in the trailing edge clamping device and generating a signal in response to a condition detected, and at least one transmitter for transmitting the signal from the plate cylinder to stationary parts of the printing press.

9. The detecting device according to claim 8, including at least one sensor disposed in a leading edge clamping device of the plate cylinder.

10. The detecting device according to claim 8, wherein said transmitter is so constructed as to transmit the signal from the plate cylinder in a contact-free manner to the stationary parts of the printing press.

11. The detecting device according to claim 10, wherein said transmitter includes at least two coils which are located opposite one another at least once during each revolution of the plate cylinder.

12. The detecting device according to claim 8, wherein the printing press has a press control constructed so that it furthers an operation of unclamping a printing plate only when said press control receives a signal from said at least one sensor indicating that the printing plate trailing edge has left said trailing edge clamping device.

13. The detecting device according to claim 12, wherein said press control is constructed so as to clear the plate cylinder for a new printing plate to be clamped thereon only when said press control receives a signal from said at least one sensor indicating that the printing plate leading edge has left the leading edge clamping device.

14. The detecting device according to claim 8, wherein said at least one sensor disposed in the trailing edge clamping device is also for detecting a position of the printing plate trailing edge in the trailing edge clamping device, and generates a signal indicating that the printing plate trailing edge is positioned in-register in the trailing edge clamping device, and the printing press has a press control constructed so as to continue an operation of clamping a new printing plate only when said press control receives the signal from said at least one sensor disposed in the trailing edge clamping device indicating that the printing plate trailing edge is positioned in-register in the trailing edge clamping device.

15. The detecting device according to claim 14, further comprising at least one sensor disposed in a leading edge clamping device of the plate cylinder for detecting a position of the printing plate leading edge in the leading edge clamping device and generating a signal indicating that the printing plate leading edge is positioned in-register in the leading edge clamping device, and said press control constructed so as to clear the printing press for printing only when said press control receives the signal from said at least one sensor disposed in the leading edge clamping device indicating that the printing plate leading edge is positioned in-register in the leading edge clamping device.

16. The detecting device according to claim 8, wherein said at least one sensor comprises an electric contact which is closed due to the presence of a printing plate.

17. The detecting device according to claim 8, wherein said at least one sensor comprises an electric microswitch.

18. The detecting device according to claim 8, wherein said at least one sensor is an inductively acting sensor.

19. The detecting device according to claim 8, wherein said at least one sensor is a capacitively acting sensor.

20. The detecting device according to claim 8, wherein said at least one sensor is an optically acting sensor.

21. The detecting device according to claim 8, wherein said at least one sensor is an ultrasonic sensor.

22. The detecting device according to claim 8, wherein said at least one sensor for said trailing edge clamping device is constructed so as to detect a required depth of engagement of a bent-away printing plate trailing edge in said trailing edge clamping device.

23. The detecting device according to claim 8, wherein said at least one sensor includes two sensors located in an outer region of the trailing edge clamping device.

* * * * *